US009423707B2

(12) United States Patent
Yumita et al.

(10) Patent No.: US 9,423,707 B2
(45) Date of Patent: Aug. 23, 2016

(54) ELECTROPHOTOGRAPHIC PHOTORECEPTOR, AND METHOD AND APPARATUS OF FORMING ELECTROPHOTOGRAPHIC IMAGE

(71) Applicant: Konica Minolta, Inc., Tokyo (JP)

(72) Inventors: Masanori Yumita, Hachioji (JP); Daisuke Kodama, Hino (JP); Mari Konishi, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/803,718

(22) Filed: Jul. 20, 2015

(65) Prior Publication Data

US 2016/0054668 A1 Feb. 25, 2016

(30) Foreign Application Priority Data

Aug. 25, 2014 (JP) ..... 2014-170006

(51) Int. Cl.
*G03G 5/147* (2006.01)

(52) U.S. Cl.
CPC ..... *G03G 5/14704* (2013.01); *G03G 5/14713* (2013.01)

(58) Field of Classification Search
CPC ..... G03G 5/14704
See application file for complete search history.

(56) References Cited

FOREIGN PATENT DOCUMENTS

| | | | | |
|---|---|---|---|---|
| JP | 2009224136 A | * | 10/2009 | ..... H05B 33/14 |
| JP | 2013130603 A | | 7/2013 | |
| JP | 2014021133 A | | 2/2014 | |

* cited by examiner

*Primary Examiner* — Hoa V Le
(74) *Attorney, Agent, or Firm* — Lucas & Mercanti, LLP

(57) ABSTRACT

The electrophotographic photoreceptor of the present invention includes a conductive support, a photosensitive layer disposed on the conductive support, and a surface protective layer disposed on the photosensitive layer. The surface protective layer contains a binder resin and a fine particulate material containing at least one compound selected from $MgCu_2O_2$, $CaCu_2O_2$, $SrCu_2O_2$, and $BaCu_2O_2$.

6 Claims, 2 Drawing Sheets

ELECTROPHOTOGRAPHIC PHOTORECEPTOR, AND METHOD AND APPARATUS OF FORMING ELECTROPHOTOGRAPHIC IMAGE

CROSS REFERENCE TO RELATED APPLICATION

This Application claims the priority of Japanese Patent Application No. 2014-170006 filed on Aug. 25, 2014, which is incorporated by reference herein.

BACKGROUND OF THE INVENTION

1. Field of the Invention

The present invention relates to an electrophotographic photoreceptor and a method and an apparatus of forming an electrophotographic image. In particular, the present invention relates to an electrophotographic photoreceptor that contains a p-type semiconductor fine particulate material in an amount smaller than that of a commonly used $CuAlO_2$ fine particulate material, that maintains a low residual potential over a long period of time, that causes no residual image on the photoreceptor surface even after repeated use, that causes no blurred image even under high-temperature and high-humidity conditions, and that exhibits excellent durability, and a method and an apparatus of forming an electrophotographic image.

2. Description of Related Art

A typical electrophotographic image-forming apparatus includes an electrophotographic photoreceptor (hereinafter also referred to simply as "photoreceptor"), such as an inorganic photoreceptor or an organic photoreceptor.

In an "electrophotographic" image-forming process, the photoconductive photoreceptor is charged in a dark place by, for example, corona discharge and is then exposed to selectively dissipate only the charges on the exposed portions and to produce an electrostatic latent image, and the latent image is developed into a visualized image with a toner containing a resin material and a colorant, such as a dye or pigment.

The organic photoreceptor is more advantageous than the inorganic photoreceptor in terms of high selectivity on a photosensitive wavelength range, high film formability, high flexibility, high transparency of the resultant film, high mass productivity, low toxicity, and low production cost. Thus, most current photoreceptors are organic photoreceptors.

Such a photoreceptor is required to have high durability in view of, for example, a reduction in environmental load, an improvement in productivity, and a reduction in production cost.

A recent technique for enhancing the durability of the photoreceptor involves addition of a filler (inorganic fine particles) to a surface protective layer, to strengthen the layer for a prolonged service life.

Unfortunately, a common filler used in this technique is a fine particulate electron transporting n-type semiconductor, such as aluminum oxide, titanium dioxide, or tin oxide, and the filler leads to an increase in residual potential after repeated exposure, resulting in failure to achieve stable image formation. This is probably attributed to the fact that the fine particulate n-type semiconductor in the surface protective layer has no hole transporting ability, and thus holes are trapped at the interface between the charge transporting layer and the surface protective layer and at grain boundaries in the surface protective layer, resulting in ineffective cancellation of negative charges on the surface of the photoreceptor.

Although addition of a charge transporting material (CTM) to the surface protective layer in combination with the fine particulate n-type semiconductor can solve the problems involved in image formation, the charge transporting material serves as a plasticizer, leading to a reduction in surface hardness. Thus, much difficulty is encountered in achieving both the hole transporting ability and high strength of the surface protective layer.

A known technique for solving such a problem involves addition of a fine particulate p-type semiconductor as a filer having hole transporting ability. The fine particulate p-type semiconductor is, for example, $CuAlO_2$ fine particles (see, for example, Japanese Unexamined Patent Application Publication Nos. 2013-130603 and 2014-021133).

Addition of $CuAlO_2$ fine particles can achieve both high strength and necessary hole transportation. For higher-speed printing, the photoreceptor is required to have improved hole transporting ability. If the amount of $CuAlO_2$ fine particles added to the surface protective layer is increased for further improvement of hole transporting ability, the number of hydroxy groups derived from the fine particles is also increased, and thus moisture in air is adsorbed onto the hydroxy groups, leading to a reduction in resistance, resulting in blurred images under high temperature and high humidity conditions. Hydrophobization of the entire hydroxy groups with a silane coupling agent, which may solve the aforementioned problems, is very difficult to perform.

SUMMARY OF THE INVENTION

The present invention has been attained in consideration of the problems and circumstances described above. An object of the present invention is to provide an electrophotographic photoreceptor that contains a p-type semiconductor fine particulate material in an amount smaller than that of a commonly used $CuAlO_2$ fine particulate material, that maintains a low residual potential over a long period of time, that causes no residual image on the photoreceptor surface even after repeated use, that causes no blurred image even under high-temperature and high-humidity conditions, and that exhibits excellent durability. Another object of the present invention is to provide a method and an apparatus of forming an electrophotographic image.

In order to solve the aforementioned problems, the present inventors, who have conducted studies on the cause of the problems, have consequently found that an electrophotographic photoreceptor including a surface protective layer containing a fine particulate material containing one p-type semiconductor compound selected from $MgCu_2O_2$, $CaCu_2O_2$, $SrCu_2O_2$, and $BaCu_2O_2$ exhibits a photoreceptive function even if the amount of the fine particulate material is smaller than that of a commonly used $CuAlO_2$ fine particulate material, and have also found that the electrophotographic photoreceptor causes no blurred image even under high-temperature and high-humidity conditions and exhibits excellent durability.

According to a first aspect of a preferred embodiment of the present invention, there is provided an electrophotographic photoreceptor including a conductive support, a photosensitive layer disposed on the conductive support, and a surface protective layer disposed on the photosensitive layer, wherein the surface protective layer contains a binder resin and a fine particulate material containing at least one compound selected from $MgCu_2O_2$, $CaCu_2O_2$, $SrCu_2O_2$, and $BaCu_2O_2$.

Preferably, the surface protective layer contains a binder resin and a fine particulate material containing at least $SrCu_2O_2$.

Preferably, the binder resin contains a resin prepared by polymerization of a polymerizable compound.

Preferably, the fine particulate material containing $SrCu_2O_2$ has a number average primary particle size of 1 to 1,000 nm.

According to a second aspect of a preferred embodiment of the present invention, there is provided a method of forming an electrophotographic image, including using the electrophotographic photoreceptor according to the first aspect of the present invention.

According to a third aspect of a preferred embodiment of the present invention, there is provided an apparatus of forming an electrophotographic image, including the electrophotographic photoreceptor according to the first aspect of the present invention.

The mechanism by which the advantageous effects of the present invention are expressed is presumed as follows:

$MgCu_2O_2$, $CaCu_2O_2$, $SrCu_2O_2$, or $BaCu_2O_2$ particles have hole transporting ability higher than that of $CuAlO_2$ particles. Thus, even if the amount of $MgCu_2O_2$, $CaCu_2O_2$, $SrCu_2O_2$, or $BaCu_2O_2$ particles added is reduced, the resultant photoreceptor exhibits electrical characteristics superior to those achieved by addition of $CuAlO_2$ particles, and the photoreceptor maintains a low residual potential over a long period of time and precludes occurrence of residual image on the photoreceptor surface. A small amount of p-type semiconductor particles added in the surface protective layer leads to a reduction in number of hydroxy groups derived from the particles, and thus a reduction in residual image or blurred image under high-temperature and high-humidity conditions.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

Figure 1:
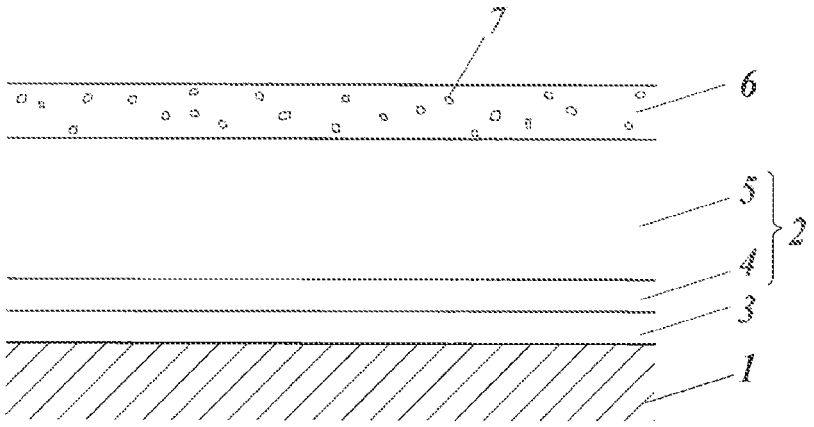
FIG. 1 schematically illustrates an exemplary layer configuration of a photoreceptor.

The electrophotographic photoreceptor of the present invention includes a conductive support, a photosensitive layer, and a surface protective layer disposed in sequence. The surface protective layer contains a binder resin and a fine particulate material containing at least one compound selected from $MgCu_2O_2$, $CaCu_2O_2$, $SrCu_2O_2$, and $BaCu_2O_2$. These technical characteristics are common to Aspects 1 to 6 of the present invention.

In an embodiment of the present invention, the surface protective layer preferably contains a binder resin and a fine particulate material containing $SrCu_2O_2$ for attaining the advantageous effects of the present invention.

The binder resin preferably contains a resin prepared by polymerization of a polymerizable compound for achieving a favorable surface hardness.

The $SrCu_2O_2$-containing fine particulate material preferably has a number average primary particle size of 1 to 1,000 nm for facilitating production of the photoreceptor.

The electrophotographic photoreceptor of the present invention is suitable for use in a method of forming an electrophotographic image.

The electrophotographic photoreceptor of the present invention is suitable for use in an apparatus of forming electrophotographic image.

The present invention, the contexture thereof, and embodiments and aspects for implementing the present invention will now be described in detail. As used herein, the term "to" between two numerical values indicates that the numeric values before and after the term are inclusive as the lower limit value and the upper limit value, respectively.

[Electrophotographic Photoreceptor]

The electrophotographic photoreceptor of the present invention includes a conductive support, a photosensitive layer, and a surface protective layer disposed in sequence. The surface protective layer contains a binder resin and a fine particulate material containing at least one compound selected from $MgCu_2O_2$, $CaCu_2O_2$, $SrCu_2O_2$, and $BaCu_2O_2$.

The photosensitive layer has both a function of absorbing light to generate charges and a function of transporting charges. The photosensitive layer may have a single-layer configuration containing a charge generating material and a charge transporting material, or may have a multilayer configuration including a charge generating sublayer containing a charge generating material and a charge transporting sublayer containing a charge transporting material.

An intermediate layer may optionally be disposed between the conductive support and the photosensitive layer.

The photosensitive layer may have any layer configuration. Specific examples of the layer configuration including a surface protective layer are as follows:

(1) a layer configuration including a conductive support, a charge generating layer, a charge transporting layer, and a surface protective layer disposed in sequence;

(2) a layer configuration including a conductive support, a single photosensitive layer containing a charge generating material and a charge transporting material, and a surface protective layer disposed in sequence;

(3) a layer configuration including a conductive support, an intermediate layer, a charge generating layer, a charge transporting layer, and a surface protective layer disposed in sequence; and (4) a layer configuration including a conductive support, an intermediate layer, a single photosensitive layer containing a charge generating material and a charge transporting material, and a surface protective layer disposed in sequence.

The photoreceptor of the present invention may have any of the aforementioned layer configurations (1) to (4). Of these, particularly preferred is the layer configuration including a conductive support, an intermediate layer, a charge generating layer, a charge transporting layer, and a surface protective layer disposed in sequence.

FIG. 1 schematically illustrates an exemplary layer configuration of the photoreceptor 10 according to the present invention. The photoreceptor 10 includes a conductive support 1, a photosensitive layer 2, an intermediate layer 3, a charge generating layer 4, a charge transporting layer 5, a surface protective layer 6, and surface-modified metal oxide fine particles 7.

Now will be sequentially described the structures of the surface protective layer, conductive support, intermediate layer, and photosensitive layer (charge generating layer and charge transporting layer) of the photoreceptor according to the present invention.

<Surface Protective Layer>

In the present invention, the surface protective layer contains a binder resin and fine particles containing one compound selected from $MgCu_2O_2$, $CaCu_2O_2$, $SrCu_2O_2$, and $BaCu_2O_2$ (hereinafter the fine particles will also be referred to simply as "p-type semiconductor particles").

The p-type semiconductor particles, which contain one compound selected from $MgCu_2O_2$, $CaCu_2O_2$, $SrCu_2O_2$, and $BaCu_2O_2$ as a main component, may further contain an inorganic compound (e.g., any other metal oxide), within the advantageous effects of the present invention.

In the present invention, the surface protective layer particularly preferably contains a binder resin and fine particles containing $SrCu_2O_2$ (hereinafter also referred to simply as "$SrCu_2O_2$ fine particles").

(P-Type Semiconductor Particles)

In the p-type semiconductor particles, holes serve as charge carriers; i.e., holes are majority carriers.

The p-type semiconductor particles have a number average primary particle size of preferably 1 to 1,000 nm, particularly preferably 10 to 500 nm.

In the present invention, the $SrCu_2O_2$ fine particles have a number average primary particle size of particularly preferably 1 to 1,000 nm.

The surface protective layer preferably contains two or more p-type particulate semiconductor materials having different number average primary particle sizes. In this case, at least one p-type particulate semiconductor material preferably has a number average primary particle size of 10 to 50 nm. Formation of the surface protective layer from two or more p-type particulate semiconductor materials having different particle sizes causes surface irregularities, leading to an improvement in cleaning performance.

The number average primary particle size of the p-type semiconductor particles is determined as follows: The particles are photographed at a magnification of 100,000 with a scanning electron microscope (e.g., JSM-7500F, manufactured by JEOL Ltd.), and the photographic image including randomly selected 100 particles (excluding agglomerated particles) read by a scanner is converted into a binary image with an automatic image analyzer (e.g., "LUZEX AP" with software version Ver. 1.32, manufactured by NIRECO Corporation). The horizontal Feret's diameters of random 100 particles are calculated, and the average value of the Feret's diameters is defined as the number average primary particle size. As used herein, the "horizontal Feret's diameter" refers to the length of a side (parallel to the x-axis) of a rectangle circumscribing a binarized image of a p-type semiconductor particle.

The $SrCu_2O_2$ fine particles can be prepared in accordance with, for example, the method described in Japanese Unexamined Patent Application Publication No. 2003-286096. Specifically, a mixture of copper oxide and strontium oxide or strontium carbonate is melted at 1,000° C. or higher in an argon or nitrogen atmosphere containing oxygen in an amount of 5% or less. Thereafter, while the mixture is cooled to a temperature below or near its melting point, $SrCu_2O_2$ fine crystals are deposited on a seed crystal or a substrate, and a $SrCu_2O_2$ single crystal is grown thereon. The resultant single crystal is pulverized and sieved (classified), to prepare $SrCu_2O_2$ fine particles having a specific particle size.

The aforementioned p-type semiconductor particles other than the $SrCu_2O_2$ fine particles can be prepared as in the preparation of the $SrCu_2O_2$ fine particles, except that strontium oxide or strontium carbonate is replaced with an oxide containing an atom corresponding to the p-type semiconductor particles.

The p-type semiconductor particles are preferably treated with a surface modifier.

(Surface Modifier)

The surface modifier is preferably reactive with, for example, a hydroxy group present on the surfaces of the p-type semiconductor particles. Examples of such a surface modifier include silane coupling agents and titanium coupling agents.

In the present invention, a surface modifier having a reactive organic group is preferably used for further enhancing the hardness of the surface protective layer. The reactive organic group is preferably a radically polymerizable functional group. The surface modifier having a radically polymerizable functional group reacts with the below-described curable compound, to form a strong surface protective layer.

The surface modifier having a radically polymerizable functional group is preferably a silane coupling agent having a radically polymerizable functional group, such as a vinyl group or an acryloyl group. Examples of the surface modifier having such a radically polymerizable functional group include the following known compound:

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)\ COO(CH_2)_2Si(CH_3)(OCH_3)_2$
S-13: $CH_2{=}C(CH_3)\ COO(CH_2)_2Si(OCH_3)_3$
S-14: $CH_2{=}C(CH_3)\ COO(CH_2)_3Si(CH_3)(OCH_3)_2$
S-15: $CH_2{=}C(CH_3)\ COO(CH_2)_3Si(OCH_3)_3$
S-16: $CH_2{=}C(CH_3)\ COO(CH_2)_2Si(CH_3)\ Cl_2$
S-17: $CH_2{=}C(CH_3)\ COO(CH_2)_2SiCl_3$
S-18: $CH_2{=}C(CH_3)\ COO(CH_2)_3Si(CH_3)\ Cl_2$
S-19: $CH_2{=}C(CH_3)\ COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)\ COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Alternatively, any surface modifier other than these compounds S-1 to S-36 may be used, and the surface modifier may be a silane compound having a reactive organic group capable of radical polymerization. These surface modifiers may be used alone or in combination.

(Preparation of Surface-Modified p-Type Semiconductor Particles)

In a preferred surface modification process, the particles (100 parts by mass) are mixed with a surface modifier (0.1 to 100 parts by mass) and a solvent (50 to 5,000 parts by mass), and the resultant mixture is treated with a wet-media disperser. The surface modification may be performed in a dry process.

Now will be described a process for uniformly treating the particles with a surface modifier.

Specifically, a slurry (suspension of solid particles) containing untreated p-type semiconductor particles and a surface modifier is subjected to wet disintegration, to form p-type semiconductor fine particles and to achieve surface modification of the particles. The solvent is then removed, followed by powderization, to prepare p-type semiconductor particles having surfaces uniformly treated with the surface modifier.

The wet-media disperser, which is a surface modifying apparatus used in the present invention, has a container loaded with media beads and a stirring disk mounted vertically to a rotary shaft. The stirring disk rapidly spins to mill and disperse agglomerated p-type semiconductor particles. Any type of disperser may be used which can sufficiently disperse the p-type semiconductor particles during the surface modification of the p-type semiconductor particles. Various types of disperser may be used, such as a vertical type, a horizontal type, a continuous type, and a batch type.

Specific examples of the disperser include a sand mill, an Ultravisco mill, a pearl mill, a grain mill, a Dyno mill, an agitator mill, and a dynamic mill. Such a disperser pulverizes and disperses particles by impact cracking, friction, shear force, or shear stress provided by grinding media, such as balls and beads.

The beads used in the wet-media disperser may be spheres formed of, for example, glass, alumina, zircon, zirconia, steel, or flint. Particularly preferred beads are formed of zirconia or zircon. Although the diameter of the beads is usually about 1 to 2 mm, a preferred diameter is about 0.1 to 1.0 mm in the present invention.

The disk and the inner wall of the container of the wet-media disperser may be formed of any material, such as stainless steel, nylon, or ceramic. In the present invention, the disk and the inner wall of the container are preferably formed of a ceramic material, such as zirconia or silicon carbide.

The surface-modified p-type semiconductor particles are prepared through the aforementioned wet process.

(Binder Resin)

The binder resin preferably contains a resin prepared by polymerization of a polymerizable compound.

The resin prepared by polymerization of a polymerizable compound may be, for example, a resin prepared through curing of a curable compound, or any known resin, such as a polyester resin, a polycarbonate resin, or a silicone resin. A curable resin and a non-curable resin may be used in combination.

In the present invention, the curable compound used in the surface protective layer may be a radically polymerizable compound.

The radically polymerizable compound is preferably a polymerizable monomer having at least one of an acryloyl group and a methacryloyl group, which are radically polymerizable functional groups.

Examples of the polymerizable monomer usable in the present invention include, but are not limited to, the following compounds:

[Chemical Formula 1]

M1

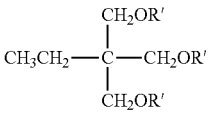

-continued

M2

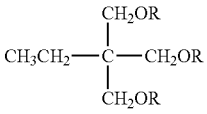

M3

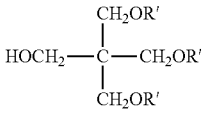

M4

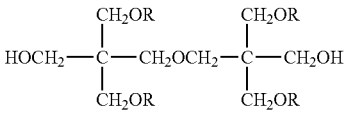

M5

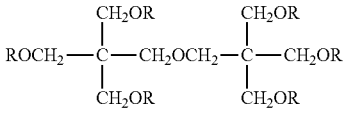

M6

M7

[Chemical Formula 2]

M8

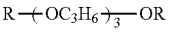

M9

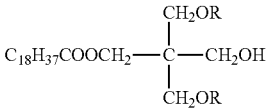

M10

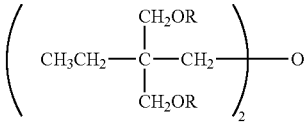

M11

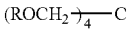

M12

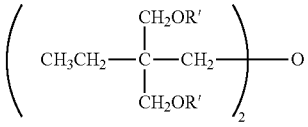

M13

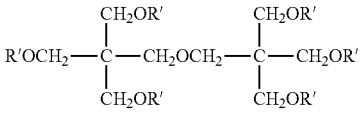

M14

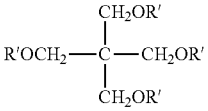

M15

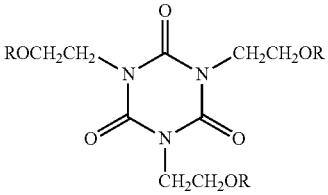

These radically polymerizable compounds are known and commercially available. In these chemical formulae, R and R' are the following acryloyl group and methacryloyl group, respectively:

[Chemical Formula 3]

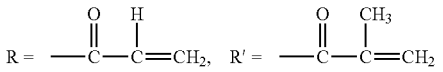

In the present invention, the surface protective layer may optionally contain a polymerization initiator and lubricant particles in addition to the aforementioned components.

(Polymerization Initiator)

In the present invention, a curable compound used in the surface protective layer can be cured through, for example, electron-beam cleavage, or application of light or heat in the presence of a radical polymerization initiator.

The radical polymerization initiator used for curing reaction may be a photopolymerization initiator or a thermal polymerization initiator. Alternatively, a photopolymerization initiator and a thermal polymerization initiator may be used in combination.

Examples of the thermal polymerization initiator usable in the present invention include azo compounds, such as 2,2'-azobisisobutyronitrile, 2,2'-azobis(2,4-dimethylazobisvaleronitrile), and 2,2'-azobis(2-methylbutyronitrile); and peroxides, such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of the photopolymerization initiator include acetophenone and ketal initiators, such as diethoxyacetophenone, 2,2-dimethoxy-1,2-diphenylethan-1-one, 1-hydroxycyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 (Irgacure 369, manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether initiators, such as benzoin, benzoin methyl ether, benzoin ethyl ether, benzoin isobutyl ether, and benzoin isopropyl ether; benzophenone initiators, such as benzophenone, 4-hydroxybenzophenone, o-benzoyl methyl benzoate, 2-benzoylnaphthalene, 4-benzoylbiphenyl, 4-benzoyl phenyl ether, acrylated benzophenone, and 1,4-benzoylbenzene; and thioxanthone initiators, such as 2-isopropylthioxanthone, 2-chlorothioxanthone, 2,4-dimethylthioxanthone, 2,4-diethylthioxanthone, and 2,4-dichlorothioxanthone.

Other photopolymerization initiators include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide (Irgacure 819, manufactured by BASF Japan Ltd.), bis(2,4-dimethoxybenzoyl)-2,4,4-trimethylpentylphosphine oxide, methylphenylglyoxyester, 9,10-phenanthrene, acridine compounds, triazine compounds, and imidazole compounds.

A compound having a photopolymerization promoting effect may be used alone or in combination with any of the aforementioned photopolymerization initiators. Examples of the compound having a photopolymerization promoting effect include triethanolamine, methyldiethanolamine, 4-dimethylaminoethyl benzoate, 4-dimethylaminoisoamyl benzoate, (2-dimethylamino)ethyl benzoate, and 4,4'-dimethylaminobenzophenone.

The polymerization initiator used in the present invention is preferably a photopolymerization initiator, more preferably an alkylphenone compound or a phosphine oxide compound, still more preferably a photopolymerization initiator having an α-hydroxyacetophenone structure or an acylphosphine oxide structure.

These polymerization initiators may be used alone or in combination. The polymerization initiator is usually used in an amount of 0.1 to 40 parts by mass, preferably 0.5 to 20 parts by mass, relative to 100 parts by mass of the polymerizable compound.

(Lubricant Particles)

The surface protective layer may contain lubricant particles; for example, fluorine-containing resin particles.

Examples of the fluorine-containing resin include tetrafluoroethylene resins, trifluorochloroethylene resins, hexafluorochloroethylene-propylene resins, vinyl fluoride resins, vinylidene fluoride resins, difluorodichloroethylene resins, and copolymers thereof. Of these, preferred are one or more appropriately selected resins. Particularly preferred are tetrafluoroethylene resins and vinylidene fluoride resins.

(Solvent)

Examples of the solvent used for formation of the surface protective layer include, but are not limited to, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine.

(Formation of Surface Protective Layer)

The surface protective layer is formed through the following process. A coating dispersion is prepared by adding, to a solvent, the binder resin (radically polymerizable, curable compound), the surface-modified p-type semiconductor particles, and an optional component, such as a known resin, a polymerization initiator, lubricant particles, or an antioxidant. The coating dispersion is applied onto the surface of the photosensitive layer by a known process, followed by spontaneous drying or thermal drying. Thereafter, the resultant coating film is cured.

The surface protective layer preferably has a thickness of 0.2 to 10 μm, more preferably 0.5 to 6 μm.

For formation of the surface protective layer in the present invention, the coating film is preferably irradiated with actinic rays to generate radicals that initiate polymerization and intermolecular and intramolecular cross-linking reactions, to cure the curable resin. The actinic rays are preferably UV rays, visible light, or electron beams. UV rays, which are easy to use, are particularly preferred.

Any UV source may be used. Examples of the UV source include low-pressure mercury lamps, middle-pressure mercury lamps, high-pressure mercury lamps, ultrahigh-pressure mercury lamps, carbon-arc lamps, metal halide lamps, xenon lamps, flash (pulsed) xenon lamps, and UV LEDs.

The conditions of emitting actinic rays may vary depending on the type of the lamp. The dose of actinic rays is usually 1 to 20 mJ/cm$^2$, preferably 5 to 15 mJ/cm$^2$.

The output power of the light source is preferably 0.1 to 5 kW, particularly preferably 0.5 to 3 kW.

Any electron beam emitting device (electron beam source) may be used. In general, a curtain beam-type electron beam emitting device, which is relatively inexpensive and outputs high power, is effectively used as an electron beam accelerator.

The accelerating voltage during emission of electron beams is preferably 100 to 300 kV. The absorbed dose is preferably 0.005 Gy to 100 kGy (0.5 to 10 Mrad).

The time for emission of actinic rays is determined depending on a necessary dose of actinic rays. The emission time is preferably 0.1 seconds to 10 minutes, more preferably 1 second to 5 minutes, from the viewpoint of curing or operational efficiency.

The surface protective layer may be dried before, during, or after emission of actinic rays. The timing of drying may be appropriately determined in combination with the actinic ray emission conditions.

The drying conditions for the surface protective layer may be appropriately determined depending on the type of the solvent used for the coating dispersion or the thickness of the surface protective layer. The drying temperature is preferably room temperature to 180° C., particularly preferably 80 to 140° C. The drying period is preferably 1 to 200 minutes, particularly preferably 5 to 100 minutes. In the present invention, drying of the surface protective layer under these conditions can control the amount of the solvent contained in the protective layer to 20 ppm to 75 ppm.

<Conductive Support>

Any conductive support can be used in the present invention. Examples of the conductive support include drums and sheets formed of metals, such as aluminum, copper, chromium, nickel, zinc, and stainless steel; plastic films laminated with metal foil of aluminum or copper; plastic films provided with deposited layers of aluminum, indium oxide, or tin oxide; and metal and plastic films and paper sheets having conductive layers formed through application of a conductive substance alone or in combination with a binder resin.

(Intermediate Layer)

In the present invention, an intermediate layer having a barrier function and an adhesive function can be provided between the conductive support and the photosensitive layer.

The intermediate layer can be formed by dissolving a binder resin in a known solvent, and applying the resultant solution to the conductive support by, for example, dip coating. Examples of the binder resin include casein, poly(vinyl alcohol), nitrocellulose, ethylene-acrylic acid copolymers, polyamides, polyurethanes, and gelatin. Among these binder resins, preferred are alcohol-soluble polyamide resins.

The intermediate layer may contain any conductive particulate or metal oxide particulate for controlling the resistance. Examples thereof include particles of metal oxides, such as alumina, zinc oxide, titanium oxide, tin oxide, antimony oxide, indium oxide, and bismuth oxide; and ultrafine particles of tin-doped indium oxide, antimony-doped tin oxide, and antimony-doped zirconium oxide.

These particulate metal oxides may be used alone or in combination. A mixture of two or more particulate metal oxides may be in the form of solid solution or fusion.

Such metal oxide particles preferably have a number average primary particle size of 0.3 μm or less, more preferably 0.1 μm or less.

The solvent used for formation of the intermediate layer is preferably one which can effectively disperse inorganic particles such as conductive fine particles or metal oxide particles and can dissolve a binder resin such as a polyamide resin.

Specific examples of preferred solvents include alcohols having two to four carbon atoms, such as ethanol, n-propyl alcohol, isopropyl alcohol, n-butyl alcohol, t-butyl alcohol, and sec-butyl alcohol, which exhibit high solubility for polyamide resins (i.e., preferred binder resins) and high coating characteristics.

Any auxiliary solvent may be used for improving storage stability or the dispersibility of inorganic fine particles. Examples of effective auxiliary solvents include methanol, benzyl alcohol, toluene, cyclohexanone, and tetrahydrofuran.

The binder resin concentration of the coating dispersion is appropriately determined depending on the thickness of the intermediate layer or the type of the coating process. The inorganic particles are preferably mixed with the binder resin in an amount of 20 to 400 parts by mass, more preferably 50 to 200 parts by mass, relative to 100 parts by mass of the binder resin.

The inorganic fine particles may be dispersed with any device. Examples of the device include, but are not limited to, an ultrasonic disperser, a ball mill, a sand grinder, and a homomixer.

The intermediate layer may be dried by any known technique appropriately determined depending on the type of the solvent or the thickness of the layer. Thermal drying is particularly preferred.

The intermediate layer preferably has a thickness of 0.1 to 15 μm, more preferably 0.3 to 10 μm.

(Photosensitive Layer)

As described above, the photosensitive layer forming the photoreceptor of the present invention may have a single-layer provided with a charge generating function and a charge transporting function. The photosensitive layer preferably has a layer configuration including two functionally separated layers, i.e., a charge generating layer (CGL) and a charge transporting layer (CTL).

Thus, the functionally separated layer configuration can suppress an increase in residual potential due to repeated use and readily tailor various electrophotographic characteristics to requirements.

The layer configuration of a negatively chargeable photoreceptor includes an intermediate layer, a charge generating layer (CGL) disposed thereon, and a charge transporting layer (CTL) disposed on the charge generating layer. The layer configuration of a positively chargeable photoreceptor includes an intermediate layer, a charge transporting layer (CTL) disposed thereon, and a charge generating layer (CGL) disposed on the charge transporting layer. The photoreceptor is preferably a negatively chargeable photoreceptor having the aforementioned functionally separated layer configuration.

Now will be specifically described the photosensitive layers of the functionally separated negatively chargeable photoreceptor.

(Charge Generating Layer)

The charge generating layer formed in the present invention contains a charge generating material and a binder resin. The charge generating layer is preferably formed through application of a coating dispersion containing a charge generating material dispersed in a binder resin solution.

Examples of the charge generating material include, but are not limited to, azo pigments, such as Sudan Red and Diane Blue; quinone pigments, such as pyrenequinone and anthanthrone; quinocyanine pigments; perylene pigments; indigo pigments, such as indigo and thioindigo; and phthalocyanine pigments.

These charge generating materials may be used alone or in the form of dispersion in a known binder resin.

Examples of the binder resin for the charge generating layer include, but are not limited to, known resins, such as polystyrene resins, polyethylene resins, polypropylene resins, acrylic resins, methacrylic resins, vinyl chloride resins, vinyl acetate resins, poly(vinyl butyral) resins, epoxy resins, polyurethane resins, phenolic resins, polyester resins, alkyd resins, polycarbonate resins, silicone resins, melamine resins, copolymer resins containing two or more of these resins (e.g., vinyl chloride-vinyl acetate copolymer resins and vinyl chloride-vinyl acetate-maleic anhydride copolymer resins), and poly(vinylcarbazole) resins.

The charge generating layer is preferably formed through the following process. A charge generating material is dispersed in a binder resin solution with a disperser to prepare a coating dispersion, and the coating dispersion is then applied onto the intermediate layer with a coater, to form a coating film having a specific thickness, followed by drying of the coating film.

Examples of the solvent for the binder resin solution to be applied for formation of the charge generating layer include, but are not limited to, toluene, xylene, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine, and diethylamine.

The charge generating material may be dispersed with any device. Examples of the device include, but are not limited to, an ultrasonic disperser, a ball mill, a sand grinder, and a homomixer.

The charge generating material is preferably mixed with the binder resin in an amount of 1 to 600 parts by mass, more preferably 50 to 500 parts by mass, relative to 100 parts by mass of the binder resin.

The thickness of the charge generating layer may vary depending on the properties of the charge generating material, the properties of the binder resin, or the amount of the binder resin contained in the layer. The thickness is preferably 0.01 to 5 μm, more preferably 0.05 to 3 μm.

The coating dispersion for the charge generating layer may be subjected to filtration for removal of foreign matter or agglomerates before being applied to the intermediate layer, to prevent occurrence of image defects. The charge generating layer may be formed through vacuum deposition of any of the aforementioned pigments.

(Charge Transporting Layer)

The charge transporting layer formed in the present invention contains at least a charge transporting material and a binder resin. The charge transporting layer is formed through application of a coating solution containing the charge transporting material dissolved in a binder resin solution.

Examples of the charge transporting material include known compounds, such as carbazole derivatives, oxazole derivatives, oxadiazole derivatives, triazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly(N-vinylcarbazole), poly(l-vinylpyrene), and poly(9-vinylanthracene). These compounds may be used alone or in combination.

Examples of the binder resin for the charge transporting layer include known resins, such as polycarbonate resins, polyacrylate resins, polyester resins, polystyrene resins, styrene-acrylonitrile copolymer resins, polymethacrylic acid ester resins, and styrene-methacrylic acid ester copolymer resins. Of these, polycarbonate resins are preferably used. More preferred are polycarbonate resins, such as Bisphenol A (BPA), Bisphenol Z (BPZ), dimethyl BPA, and BPA-dimethyl BPA copolymers, from the viewpoints of cracking resistance, wear resistance, and charging characteristics.

The charge transporting layer can be formed by any known process, such as a coating process. In the coating process, a desired charge transporting layer is formed by dissolving a binder resin and a charge transporting material in a solvent to prepare a coating solution, and applying the solution onto the underlying layer to form a coating film having a specific thickness, followed by drying.

Examples of the solvent for dissolving the binder resin and the charge transporting material (i.e., the solvent used for preparation of the coating solution for the charge transporting layer) include, but are not limited to, toluene, xylene, methyl ethyl ketone, cyclohexanone, ethyl acetate, butyl acetate, methanol, ethanol, propanol, butanol, tetrahydrofuran, 1,4-dioxane, and 1,3-dioxolane.

The charge transporting material is preferably mixed with the binder resin in an amount of 10 to 500 parts by mass, more preferably 20 to 100 parts by mass, relative to 100 parts by mass of the binder resin.

The charge transporting layer may have any thickness depending on the properties of the charge transporting material or the binder resin, or the amount of the binder resin contained in the layer. The thickness is preferably 5 to 40 μm, more preferably 10 to 30 μm.

The charge transporting layer may contain any known antioxidant, such as an antioxidant described in Japanese Unexamined Patent Application Publication No. 2000-305291.

(Coating Process to Form the Photoreceptor)

Each of the intermediate layer, charge generating layer, charge transporting layer, and surface protective layer of the photoreceptor of the present invention can be formed by a known coating process.

Specific examples of the process include dip coating, spray coating, spinner coating, bead coating, blade coating, beam coating, and circular amount-regulating coating.

The circular amount-regulating coating process is disclosed in, for example, Japanese Unexamined Patent Application Publication Nos. S58-189061 and 2005-275373.

[Apparatus and Method of Forming Image]

The photoreceptor of the present invention can be provided in a typical apparatus of forming an electrophotographic image. The photoreceptor of the present invention is suitable for use in an electrophotographic image-forming method (hereinafter also referred to simply as "image-forming method") involving the image-forming apparatus.

Now will be described the image-forming apparatus and the image-forming method.

The image-forming apparatus for achieving the advantageous effects of the present invention includes (1) the electrophotographic photoreceptor of the present invention including a surface protective layer, (2) a charging unit to charge the surface of the electrophotographic photoreceptor, (3) an exposing unit to form a latent image on the surface of the electrophotographic photoreceptor charged with the charging unit, (4) a developing unit to develop the latent image with a toner into a toner image, and (5) a transferring unit to transfer the toner image on the surface of the electrophotographic photoreceptor onto a transfer medium (e.g., a paper sheet) or a transfer belt.

The charging unit to charge the electrophotographic photoreceptor is preferably a contactless charging device. Examples of the contactless charging device include corona charging devices, corotron charging devices, and scorotron charging devices.

Figure 2:
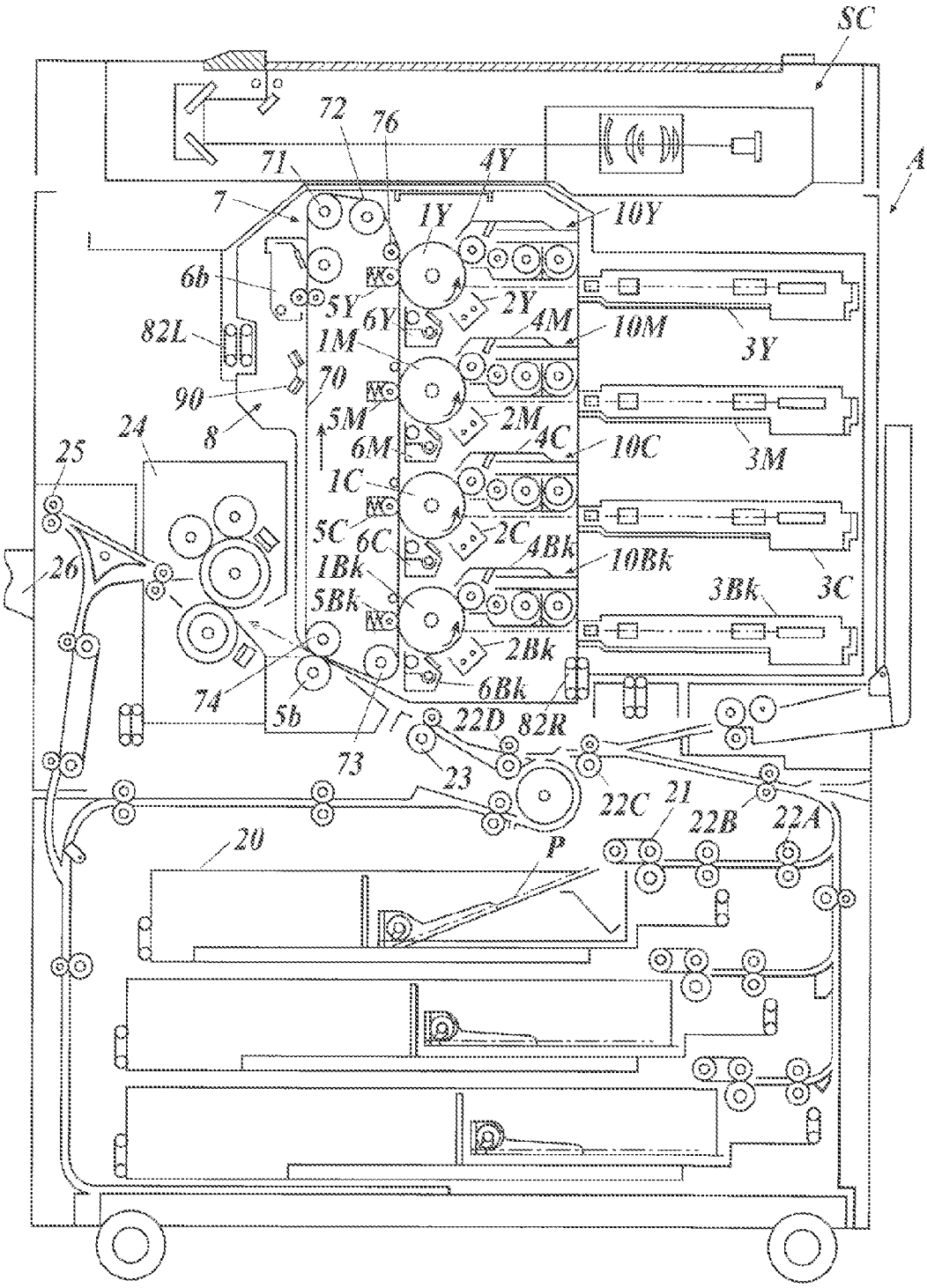
FIG. 2 is a cross-sectional view of a full-color electrophotographic image-forming apparatus according to an embodiment of the present invention.

FIG. 2 is a cross-sectional view of a full-color electrophotographic image-forming apparatus (hereinafter also referred to simply as "a color image-forming apparatus" or "an image-forming apparatus") according to an embodiment of the present invention.

The color image-forming apparatus, which is called a tandem color image-forming apparatus, includes four image-forming units 10Y, 10M, 10C, and 10Bk, an endless-belt intermediate transferring unit 7, a sheet feeding unit 21, and a fixing unit 24. The image-forming apparatus further includes a document scanner SC above a body A of the image-forming apparatus.

The image-forming unit 10Y for forming a yellow image includes a charging unit (for a charging step) 2Y, an exposing unit (for a exposing step) 3Y, a developing unit (for a developing step) 4Y, a first transferring roller (first transferring unit) (for a first transferring step) 5Y, and a cleaning unit 6Y, which are disposed around a drum photoreceptor 1Y (first image retainer).

The image-forming unit 10M for forming a magenta image includes a drum photoreceptor 1M (first image retainer), a charging unit 2M, an exposing unit 3M, a developing unit 4M, a first transferring roller 5M (first transferring unit), and a cleaning unit 6M.

The image-forming unit 10C for forming a cyan image includes a drum photoreceptor 1C (first image retainer), a charging unit 2C, an exposing unit 3C, a developing unit 4C, a first transferring roller 5C (first transferring unit), and a cleaning unit 6C.

The image-forming unit 10Bk for forming a black image includes a drum photoreceptor 1Bk (first image retainer), a charging unit 2Bk, an exposing unit 3Bk, a developing unit 4Bk, a first transferring roller 5Bk (first transferring unit), and a cleaning unit 6Bk.

The four image-forming units 10Y, 10M, 10C, and 10Bk each include the drum photoreceptor 1Y, 1M, 1C, or 1Bk at the center, the charging unit 2Y, 2M, 2C, or 2Bk, the exposing unit 3Y, 3M, 3C, or 3Bk, the developing unit 4Y, 4M, 4C, or 4Bk, and the cleaning unit 6Y, 6M, 6C, or 6Bk for cleaning the drum photoreceptor 1Y, 1M, 1C, or 1Bk.

The image-forming units 10Y, 10M, 10C, and 10Bk have the same configuration except for the colors of toner images formed on the photoreceptors 1Y, 1M, 1C, and 1Bk. Thus, the following description focuses on the image-forming unit 10Y.

The image-forming unit 10Y includes the charging unit 2Y (hereinafter also referred to simply as "charger 2Y"), the exposing unit 3Y, the developing unit 4Y, and the cleaning unit 6Y (hereinafter also referred to simply as "cleaning blade 6Y"), which are disposed around the drum photoreceptor 1Y (image retainer). The image-forming unit 10Y forms a yellow (Y) toner image on the photoreceptor 1Y. In the present embodiment, at least the drum photoreceptor 1Y, the charging unit 2Y, the developing unit 4Y, and the cleaning unit 6Y are integrated in the image-forming unit 10Y.

The charging unit 2Y provides the drum photoreceptor 1Y with a uniform potential. In the present embodiment, the drum photoreceptor 1Y is provided with the charger 2Y of corona discharge mechanism.

The exposing unit 3Y exposes the drum photoreceptor 1Y provided with the uniform potential by the charging unit 2Y in response to image signals (yellow) to form an electrostatic latent image corresponding to the yellow image. The exposing unit 3Y includes light-emitting devices (LEDs) arrayed in the axial direction of the drum photoreceptor 1Y and an imaging element (trade name: Selfoc (registered trademark) lens), or includes a laser optical device.

In the present invention, the aforementioned components, including the photoreceptor, the developing unit, and the cleaning unit, may be integrated into a processing cartridge (image-forming unit) that is detachably provided on the body of the image-forming apparatus.

Alternatively, the photoreceptor and at least one of the charging unit, the exposing unit, the developing unit, the transferring or separating unit, and the cleaning unit may be integrally supported to form a single processing cartridge (image-forming unit) that is detachably provided on the apparatus body with a guiding unit, such as a rail in the apparatus body.

The endless-belt intermediate transferring unit 7 includes an endless semiconductive intermediate transferring belt 70 (second image retainer) wound around and rotatably supported by multiple rollers.

The color images formed by the image-forming units 10Y, 10M, 10C, and 10Bk are sequentially transferred onto the rotating intermediate transferring belt 70 with the respective first transferring rollers 5Y, 5M, 5C, and 5Bk (first transferring units), to form a synthesized color image.

A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* (second transferring unit) via multiple intermediate rollers 22A, 22B, 22C, and 22D and register rollers 23. The color image on the intermediate transferring belt 70 is transferred at once onto the transfer medium P in a second transferring operation.

The color image transferred on the transfer medium P is fixed by the fixing unit 24. The transfer medium P is then pinched between discharging rollers 25 and is conveyed to a sheet receiving tray 26 provided outside of the apparatus. The transfer supports for retaining a toner image transferred from the photoreceptor, such as the intermediate transferring belt and the transfer medium, are collectively called transfer medium.

After the transfer of the color image onto the transfer material P with the second transferring roller 5*b* (second transferring unit) and the curved separation of the transfer material P from the turning intermediate transferring belt 70, the residual toner on the intermediate transferring belt 70 is removed by the cleaning unit 6*b*.

The first transferring roller 5Bk abuts the photoreceptor 1Bk all the time during the image formation. The first transferring rollers 5Y, 5M, and 5C abut the respective photoreceptors 1Y, 1M, and 1C only during the formation of a color image.

The second transferring roller 5*b* abuts the intermediate transferring belt 70 only during passage of the transfer material P therebetween for the second transferring operation.

A housing 8 can be drawn along supporting rails 82L and 82R from the apparatus body A.

The housing 8 accommodates the image-forming units 10Y, 10M, 10C, and 10Bk, and the endless-belt intermediate transferring unit 7.

The image-forming units 10Y, 10M, 10C, and 10Bk are aligned in the vertical direction. The endless-belt intermediate transferring unit 7 is disposed on the left of the photoreceptors 1Y, 1M, 1C, and 1Bk in FIG. 2.

The endless-belt intermediate transferring unit 7 includes the intermediate transferring belt 70 rotatably wound around rollers 71, 72, 73, and 74, the first transferring rollers 5Y, 5M, 5C, and 5Bk, and the cleaning unit 6*b*.

EXAMPLES

The present invention will now be described in detail by way of Examples, which should not be intended to limit the present invention. Unless otherwise specified, the terms "part(s)" and "%" in the following description indicate "part(s) by mass" and "mass %," respectively.

[Preparation of Metal Oxide Fine Particles]

<Preparation of $SrCu_2O_2$ Fine Particles>

A mixture of strontium oxide and copper oxide was melted at 1,000° C. or higher in a nitrogen atmosphere containing oxygen in an amount of 5% or less. Thereafter, while the mixture was cooled to a temperature below or near its melting point, $SrCu_2O_2$ fine crystals were deposited on a seed crystal or a substrate, and a $SrCu_2O_2$ single crystal was grown thereon. The resultant single crystal was pulverized and sieved (classified), to prepare $SrCu_2O_2$ fine particles having a number average primary particle size of 10 nm, 30 nm, 100 nm, 500 nm, or 1,000 nm.

The number average primary particle size was determined in the same manner as described above. The number average primary particle size of the following metal oxide fine particles was also determined in the same manner.

<Preparation of $MgCu_2O_2$ Fine Particles>

$MgCu_2O_2$ fine particles having a number average primary particle size of 30 nm were prepared as in the preparation of the $SrCu_2O_2$ fine particles, except that strontium oxide was replaced with magnesium oxide.

<Preparation of $CaCu_2O_2$ Fine Particles>

$CaCu_2O_2$ fine particles having a number average primary particle size of 30 nm were prepared as in the preparation of the $SrCu_2O_2$ fine particles, except that strontium oxide was replaced with calcium oxide.

<Preparation of $BaCu_2O_2$ Fine Particles>

$BaCu_2O_2$ fine particles having a number average primary particle size of 30 nm were prepared as in the preparation of the $SrCu_2O_2$ fine particles, except that strontium oxide was replaced with barium oxide.

<Preparation of $CuAlO_2$ Fine Particles>

$Al_2O_2$ (purity: 99.9%) and $Cu_2O$ (purity: 99.9%) were mixed at a molar ratio of 1:1, and the mixture was calcined in an Ar atmosphere at 1,100° C. for four days. The calcined product was then formed into pellets, and the pellets were sintered at 1,100° C. for two days into a sintered compact. Thereafter, the sintered compact was pulverized into crude particles having a particle size of several hundreds of μm. The crude particles and a solvent were applied to a wet-media disperser, to prepare $CuAlO_2$ fine particles having a number average primary particle size of 30 nm.

<Preparation of $CuInO_2$ Fine Particles>

$In_2O_2$ (purity: 99.9%) and $Cu_2O$ (purity: 99.9%) were mixed at a molar ratio of 1:1, and the mixture was calcined in an Ar atmosphere at 1,100° C. for four days. The calcined product was then formed into pellets, and the pellets were sintered at 1,100° C. for two days into a sintered compact. Thereafter, the sintered compact was pulverized into crude particles having a particle size of several hundreds of μm. The crude particles and a solvent were applied to a wet-media disperser, to prepare $CuInO_2$ fine particles having a number average primary particle size of 30 nm.

<Preparation of $CuGaO_2$ Fine Particles>

$Ga_2O_3$ (purity: 99.9%) and $Cu_2O$ (purity: 99.9%) were mixed at a molar ratio of 1:1, and the mixture was calcined in an Ar atmosphere at 1,100° C. for four days. The calcined product was then formed into pellets, and the pellets were sintered at 1,100° C. for two days into a sintered compact. Thereafter, the sintered compact was pulverized into crude particles having a particle size of several hundreds of μm. The crude particles and a solvent were applied to a wet-media disperser, to prepare $CuGaO_2$ fine particles having a number average primary particle size of 100 nm.

[Preparation of Surface-Modified Metal Oxide Fine Particles]

<Preparation of Surface-Modified $SrCu_2O_2$ Fine Particles>

$SrCu_2O_2$ fine particles having a number average primary particle size of 10 nm (i.e., metal oxide fine particles) (100 parts by mass) were mixed with the above-exemplified compound "S-15" (KBM-503 (compound name: 3-methacryloxypropyltrimethoxysilane)) (i.e., a polymerizable surface modifier) (30 parts by mass) and methyl ethyl ketone (1,000 parts by mass) in a wet sand mill (containing alumina beads having a diameter of 0.5 mm) at 30° C. for six hours. Thereafter, methyl ethyl ketone and alumina beads were separated through filtration, followed by drying at 60° C., to prepare surface-modified $SrCu_2O_2$ fine particles.

$SrCu_2O_2$ fine particles having a number average primary particle size of 30 nm, 100 nm, 500 nm, or 1,000 nm were treated in the same manner as described above, to prepare surface-modified $SrCu_2O_2$ fine particles.

<Preparation of Surface-Modified $MgCu_2O_2$ Fine Particles>

Surface-modified $MgCu_2O_2$ fine particles were prepared as in the preparation of the surface-modified $SrCu_2O_2$ fine particles, except that $MgCu_2O_2$ fine particles having a number average primary particle size of 30 nm were used as metal oxide fine particles.

<Preparation of Surface-Modified $CaCu_2O_2$ Fine Particles>

Surface-modified $CaCu_2O_2$ fine particles were prepared as in the preparation of the surface-modified $SrCu_2O_2$ fine particles, except that $CaCu_2O_2$ fine particles having a number average primary particle size of 30 nm were used as metal oxide fine particles.

<Preparation of Surface-Modified $BaCu_2O_2$ Fine Particles>

Surface-modified $BaCu_2O_2$ fine particles were prepared as in the preparation of the surface-modified $SrCu_2O_2$ fine particles, except that $BaCu_2O_2$ fine particles having a number average primary particle size of 30 nm were used as metal oxide fine particles.

<Preparation of Surface-Modified $CuAlO_2$ Fine Particles>

The above-prepared $CuAlO_2$ fine particles (100 parts by mass) were mixed with the above-exemplified compound "S-15" (i.e., a surface modifier) (7 parts by mass) and methyl ethyl ketone (1,000 parts by mass) in a wet sand mill (containing alumina beads having a diameter of 0.5 mm) at 30° C. for six hours. Thereafter, methyl ethyl ketone and alumina beads were separated through filtration, followed by drying at 60° C., to prepare surface-modified $CuAlO_2$ fine particles.

<Preparation of Surface-Modified $CuInO_2$ Fine Particles>

The above-prepared $CuInO_2$ fine particles (100 parts by mass) were mixed with the above-exemplified compound "S-15" (i.e., a surface modifier) (7 parts by mass) and methyl ethyl ketone (1,000 parts by mass) in a wet sand mill (containing alumina beads having a diameter of 0.5 mm) at 30° C. for six hours. Thereafter, methyl ethyl ketone and alumina beads were separated through filtration, followed by drying at 60° C., to prepare surface-modified $CuInO_2$ fine particles.

<Preparation of Surface-Modified $CuGaO_2$ Fine Particles>

The above-prepared $CuGaO_2$ fine particles (100 parts by mass) were mixed with the above-exemplified compound "S-6" (i.e., a surface modifier) (7 parts by mass) and methyl ethyl ketone (1,000 parts by mass) in a wet sand mill (containing alumina beads having a diameter of 0.5 mm) at 30° C. for six hours. Thereafter, methyl ethyl ketone and alumina beads were separated through filtration, followed by drying at 60° C., to prepare surface-modified $CuGaO_2$ fine particles.

<Preparation of Surface-Modified CuO Fine Particles>

Surface-modified CuO fine particles were prepared as in the preparation of the surface-modified $SrCu_2O_2$ fine particles, except that CuO fine particles having a number average primary particle size of 30 nm (commercially available product) were used as metal oxide fine particles.

[Production of Photoreceptor]

<Production of Photoreceptor 1>

A photoreceptor 1 was produced as follows:

(Support)

A conductive support was prepared through milling of the surface of a cylindrical aluminum support having a diameter of 80 mm.

(Intermediate Layer)

A dispersion having the following composition was twofold diluted with the same solvent and left to stand overnight, followed by filtration (using Rigimesh 5 μm filter, manufactured by Pall Corporation), to prepare a coating dispersion for an intermediate layer.

| | |
|---|---|
| Polyamide resin CM8000 (manufactured by Toray Industries Inc.) | 1 part by mass |
| Titanium oxide SMT500SAS (manufactured by TAYCA Corporation) | 3 parts by mass |
| Methanol | 10 parts by mass |

The dispersion was prepared through mixing of these materials with a sand mill by a batch process for 10 hours.

The coating dispersion was applied onto the conductive support through dip coating, and the resultant film was dried to form an intermediate layer having a thickness of 2 μm.

(Charge Generating Layer)

| | |
|---|---|
| Charge generating material: Y-TiPh (titanylphthalocyanine pigment having at least a maximum diffraction peak at 27.3° as measured by Cu-Kα X-ray diffractometry) | 20 parts by mass |
| Poly(vinyl butyral) resin (#6000-C: manufactured by DENKI KAGAKU KOGYO KABUSHIKI KAISHA) | 10 parts by mass |
| t-Butyl acetate | 700 parts by mass |
| 4-Methoxy-4-methyl-2-pentanone | 300 parts by mass |

A coating dispersion for a charge generating layer was prepared through mixing of these materials with a sand mill for 10 hours. The coating dispersion was applied onto the intermediate layer through dip coating, and the resultant film was dried to form a charge generating layer having a thickness of 0.3 μm.

(Charge Transporting Layer)

| | |
|---|---|
| Charge transporting material: 4,4'-dimethyl-4"-(β-phenylstyryl)triphenylamine | 225 parts by mass |
| Binder: polycarbonate Z (Z300: manufactured by Mitsubishi Gas Chemical Company, Inc.) | 300 parts by mass |
| Antioxidant (Irganox 1010: manufactured by BASF Japan Ltd.) | 6 parts by mass |
| Tetrahydrofuran | 1,600 parts by mass |
| Toluene | 400 parts by mass |
| Silicone oil (KF-54: manufactured by Shin-Etsu Chemical Co., Ltd.) | 1 part by mass |

A coating solution for a charge transporting layer was prepared through mixing and dissolution of these materials. The coating solution was applied onto the charge generating layer through dip coating, and the resultant film was dried to form a charge transporting layer having a thickness of 20 μm.

(Surface Protective Layer)

| | |
|---|---|
| Surface-modified $SrCu_2O_2$ fine particles (number average primary particle size: 10 nm) | 20 parts by mass |
| Polymerizable compound (exemplified compound M1) | 100 parts by mass |
| Polymerization initiator (Irgacure 819: manufactured by BASF Japan Ltd.) | 15 parts by mass |
| 2-Butanol | 500 parts by mass |

These materials were thoroughly mixed under stirring to prepare a coating dispersion for a surface protective layer. The coating dispersion was applied onto the charge transporting layer with a circular slide hopper coater, to form a coating film. The coating film was irradiated with UV rays from a xenon lamp for one minute, followed by drying, to form a surface protective layer having a thickness of 2.0 μm. The "photoreceptor 1" was thereby produced.

<Production of Photoreceptors 2 to 10>

Photoreceptors 2 to 10 were produced as in the photoreceptor 1, except that the amount (parts by mass) and number average primary particle size of the surface-modified $SrCu_2O_2$ fine particles for forming the surface protective layer were modified as illustrated in Table 1.

<Production of Photoreceptors 11 and 12>

Photoreceptors 11 and 12 were produced as in the photoreceptor 1, except that the surface-modified $SrCu_2O_2$ fine particles for forming the surface protective layer were replaced with surface-modified $MgCu_2O_2$ fine particles having a number average primary particle size of 30 nm, and the amount of the $MgCu_2O_2$ fine particles was modified as illustrated in Table 1.

<Production of Photoreceptors 13 and 14>

Photoreceptors 13 and 14 were produced as in the photoreceptor 1, except that the surface-modified $SrCu_2O_2$ fine particles for forming the surface protective layer were replaced with surface-modified $CaCu_2O_2$ fine particles having a number average primary particle size of 30 nm, and the amount of the $CaCu_2O_2$ fine particles was modified as illustrated in Table 1.

<Production of Photoreceptors 15 and 16>

Photoreceptors 15 and 16 were produced as in the photoreceptor 1, except that the surface-modified $SrCu_2O_2$ fine particles for forming the surface protective layer were replaced with surface-modified $BaCu_2O_2$ fine particles having a number average primary particle size of 30 nm, and the amount of the $BaCu_2O_2$ fine particles was modified as illustrated in Table 1.

<Production of Photoreceptor 17>

A photoreceptor 17 was produced as in the photoreceptor 1, except that the surface-modified $SrCu_2O_2$ fine particles for forming the surface protective layer were replaced with surface-modified $CuAlO_2$ fine particles having a number average primary particle size of 30 nm, and the amount of the $CuAlO_2$ fine particles was modified as illustrated in Table 1.

<Production of Photoreceptor 18>

A photoreceptor 18 was produced as in the photoreceptor 1, except that the surface-modified $SrCu_2O_2$ fine particles for forming the surface protective layer were replaced with surface-modified $CuInO_2$ fine particles having a number average primary particle size of 30 nm, and the amount of the $CuInO_2$ fine particles was modified as illustrated in Table 1.

<Production of Photoreceptor 19>

A photoreceptor 19 was produced as in the photoreceptor 1, except that the surface-modified $SrCu_2O_2$ fine particles for forming the surface protective layer were replaced with surface-modified $CuGaO_2$ fine particles having a number average primary particle size of 100 nm, and the amount of the $CuGaO_2$ fine particles was modified as illustrated in Table 1.

<Production of Photoreceptor 20>

A photoreceptor 20 was produced as in the photoreceptor 1, except that the surface-modified $SrCu_2O_2$ fine particles for forming the surface protective layer were replaced with surface-modified CuO fine particles having a number average primary particle size of 30 nm, and the amount of the CuO fine particles was modified as illustrated in Table 1.

EVALUATION

An initial test after continuous printing of an image on both sides of 1,000 sheets was performed under specific conditions, and a durability test after continuous printing of an image on both sides of 500,000 sheets was then performed under the same conditions. After the initial test and the durability test, the potential of a photoreceptor was measured, and the photoreceptor was evaluated for blurred image and residual image based on the criteria described below.

A commercial printer "bizhub PRO C8000" (manufactured by KONICA MINOLTA, INC.), which has basically the same configuration as that of the apparatus illustrated in FIG. 2, was modified such that the printing speed was 120 sheets/minute, and each of the above-produced photoreceptors was mounted in the modified machine for evaluation.

<Residual Potential>

Internal pattern No. 53/Dot1 (typical exposure pattern of regularly arranged dots) was continuously printed at a Bk position (density: 255) on 100 size-A3/POD gloss-coated sheets (100 g/m$^2$) (manufactured by Oji Paper Co., Ltd.) at 10° C. and 20% RH. The difference between the potential after the first exposure and that after the 100th exposure (i.e., ΔVi) was determined for evaluation.

After continuous printing of the pattern on 500,000 sheets under the same conditions as described above, the difference between the potential after the first exposure and that after the 100th exposure was determined for evaluation.

The residual potential was evaluated with "CYNTHIA59" (manufactured by GENTEC) at 10° C. and 15% RH. The surface potential of an organic photoreceptor was measured at a grid voltage of −800 V and an exposure of 0.5 μJ/cm$^2$ under repeated charging and exposure while the organic photoreceptor was rotated at 130 rpm. The residual potential was evaluated based on the following criteria in terms of ΔVi.

A: ΔVi≤20V before and after the durability test

B: ΔVi≤20V before the durability test and 35 V<ΔVi≤45V after the durability test C: 20 V<ΔVi≤40V before the durability test, or ΔVi≤40V before the durability test and 35 V<ΔVi after the durability test D: 40 V<ΔVi before the durability test <Blurred Image>

An initial test and a durability test were performed, each involving continuous printing of a character image (image area percentage: 6%) on both sides of transversely fed size-A4 sheets at 30° C. and 80% RH (1,000 sheets for the initial test and 500,000 sheets for the durability test). Immediately after the durability test, the main power supply of the machine was turned off. Twelve hours thereafter, the machine was turned on for achieving a printable state. Immediately thereafter, a halftone image (a relative reflection density of 0.4 as measured by a Macbeth densitometer) and a 6-dot grid pattern image were printed on the entire surface of a size-A3 neutralized paper sheet. The state of the printed images was visually observed and evaluated based on the following criteria.

R3: No blurred image in both the halftone and grid pattern images (excellent)

R2: A reduction in density of a thin strip extending in the longitudinal direction of the photoreceptor only in the halftone image (practically acceptable)

R1: Deficits or thinned lines in the grid pattern image due to blurred image (impractical)

<Image Memory>

After the durability test, a solid black and white image was continuously printed on 10 sheets, and a uniform halftone image was then printed on another sheet, to determine whether or not the solid black and white image remained on the halftone image for evaluation of image memory based on the following criteria.

R3: No image memory (excellent)

R2: Slight image memory (practically acceptable)

R1: Noticeable image memory (impractical)

TABLE 1

| Photo-receptor No. | Metal oxide | Number average primary particle size (nm) | Amount (parts by mass) | ΔVi | Results of evaluation: Intial (1,000 sheets) Blurred image | Intial (1,000 sheets) Residual image | After durability test (500,000 sheets) Blurred image | After durability test (500,000 sheets) Residual image | Note |
|---|---|---|---|---|---|---|---|---|---|
| 1 | $SrCu_2O_2$ | 10 | 20 | B | R2 | R2 | R2 | R2 | Example |
| 2 | $SrCu_2O_2$ | 10 | 50 | B | R2 | R3 | R2 | R2 | Example |
| 3 | $SrCu_2O_2$ | 10 | 100 | B | R3 | R3 | R2 | R3 | Example |
| 4 | $SrCu_2O_2$ | 30 | 10 | B | R3 | R3 | R2 | R2 | Example |
| 5 | $SrCu_2O_2$ | 30 | 50 | A | R3 | R3 | R3 | R3 | Example |
| 6 | $SrCu_2O_2$ | 30 | 100 | A | R3 | R3 | R2 | R3 | Example |
| 7 | $SrCu_2O_2$ | 100 | 10 | B | R2 | R2 | R2 | R2 | Example |
| 8 | $SrCu_2O_2$ | 100 | 100 | B | R2 | R3 | R2 | R2 | Example |
| 9 | $SrCu_2O_2$ | 500 | 100 | B | R2 | R3 | R2 | R3 | Example |
| 10 | $SrCu_2O_2$ | 1000 | 100 | B | R2 | R2 | R2 | R2 | Example |
| 11 | $MgCu_2O_2$ | 30 | 50 | B | R2 | R3 | R2 | R2 | Example |
| 12 | $MgCu_2O_2$ | 30 | 100 | B | R2 | R3 | R2 | R2 | Example |
| 13 | $CaCu_2O_2$ | 30 | 50 | B | R3 | R3 | R2 | R2 | Example |
| 14 | $CaCu_2O_2$ | 30 | 100 | B | R2 | R3 | R2 | R2 | Example |
| 15 | $BaCu_2O_2$ | 30 | 50 | B | R2 | R3 | R2 | R2 | Example |
| 16 | $BaCu_2O_2$ | 30 | 100 | B | R3 | R3 | R2 | R2 | Example |
| 17 | $CuAlO_2$ | 30 | 100 | C | R2 | R2 | R1 | R1 | Comparative Example |

TABLE 1-continued

| Photo-receptor No. | Metal oxide | Number average primary particle size (nm) | Amount (parts by mass) | ΔVi | Results of evaluation: Intial (1,000 sheets) Blurred image | Intial (1,000 sheets) Residual image | After durability test (500,000 sheets) Blurred image | After durability test (500,000 sheets) Residual image | Note |
|---|---|---|---|---|---|---|---|---|---|
| 18 | $CuInO_2$ | 30 | 100 | C | R2 | R2 | R1 | R1 | Comparative Example |
| 19 | $CuGaO_2$ | 100 | 100 | C | R2 | R2 | R1 | R1 | Comparative Example |
| 20 | CuO | 30 | 100 | D | ※No image formation Not evaluated | | | | Comparative Example |

With reference to Table 1, the photoreceptors 1 to 16 maintain a low residual potential over a long period of time, cause neither blurred image nor image memory even under high-temperature and high-humidity conditions, and exhibit excellent durability, compared to the photoreceptors 17 to 20.

The photoreceptors 1 to 3, which contain $SrCu_2O_2$ fine particles in an amount smaller than that of commonly used $CuAlO_2$ fine particles, exhibit the aforementioned advantageous effects.

This U.S. patent application claims priority to Japanese patent application No. 2014-170006 filed on Aug. 25, 2014, the entire contents of which are incorporated by reference herein for correction of incorrect translation.

What is claimed is:

1. An electrophotographic photoreceptor comprising:

a conductive support;

a photosensitive layer disposed on the conductive support; and a surface protective layer disposed on the photosensitive layer, wherein the surface protective layer contains a binder resin and a fine particulate material containing at least one compound selected from $MgCu_2O_2$, $CaCu_2O_2$, $SrCu_2O_2$, and $BaCu_2O_2$.

2. The electrophotographic photoreceptor according to claim 1, wherein the surface protective layer contains a binder resin and a fine particulate material containing at least $SrCu_2O_2$.

3. The electrophotographic photoreceptor according to claim 1, wherein the binder resin contains a resin prepared by polymerization of a polymerizable compound.

4. The electrophotographic photoreceptor according to claim 2, wherein the fine particulate material containing $SrCu_2O_2$ has a number average primary particle size of 1 to 1,000 nm.

5. A method of forming an electrophotographic image, comprising using the electrophotographic photoreceptor according to claim 1.

6. An apparatus of forming an electrophotographic image, comprising the electrophotographic photoreceptor according to claim 1.

* * * * *